US005698293A

United States Patent [19]

Nordlund et al.

[11] Patent Number: 5,698,293

[45] Date of Patent: Dec. 16, 1997

[54] FORMED PIECE PARTICULARLY FOR USE AS PACKING MATERIAL METHOD AND APPARATUS FOR ITS MANUFACTURE AND USE

[75] Inventors: Kai Nordlund, Tampere; Timo Mattila, Pälkäne, both of Finland

[73] Assignee: Devipack Oy, Tampere, Finland

[21] Appl. No.: 501,033

[22] PCT Filed: Feb. 10, 1994

[86] PCT No.: PCT/FI94/00053

§ 371 Date: Sep. 25, 1995

§ 102(e) Date: Sep. 25, 1995

[87] PCT Pub. No.: WO94/17990

PCT Pub. Date: Aug. 18, 1994

[30] Foreign Application Priority Data

Feb. 11, 1993 [FI] Finland ..... 930591

[51] Int. Cl.[6] ..... B31D 5/00; B65D 81/09

[52] U.S. Cl. ..... 428/153; 428/154; 428/155; 428/124; 428/906; 428/34.2; 493/452; 493/395; 493/405; 493/356; 497/967; 497/407; 206/584; 206/814

[58] Field of Search ..... 428/153, 154, 428/155, 124, 906, 34.2; 493/452, 395, 405, 407, 356, 967; 206/584, 814

[56] References Cited

U.S. PATENT DOCUMENTS

| | | | |
|---|---|---|---|
| 3,509,798 | 5/1970 | Johnson | 156/493 |
| 3,650,877 | 3/1972 | Johnson | 161/47 |
| 3,799,039 | 3/1974 | Johnson | 493/382 |
| 4,109,040 | 8/1978 | Ottaviano | 428/129 |
| 4,237,776 | 12/1980 | Ottaviano | 493/382 |
| 4,247,289 | 1/1981 | McCabe | 493/386 |
| 5,181,614 | 1/1993 | Watts | 206/584 |
| 5,468,525 | 11/1995 | Watts | 428/34.1 |
| 5,538,778 | 7/1996 | Hurwitz et al. | 428/136 |

FOREIGN PATENT DOCUMENTS

WO92/05948 4/1992 WIPO .

*Primary Examiner*—William Watkins
*Attorney, Agent, or Firm*—Pollock, Vande Sande & Priddy

[57] ABSTRACT

A formed piece comprises a substantially cylindrical outer surface layer of sheet material extending along a longitudinal axis of the formed piece from a first end to a second end of the formed piece, and inner layers of sheet material within the outer surface layer randomly arranged and creating air gaps between at least a portion of the inner layers. The surface layer and inner layers of sheet material are twisted around the longitudinal axis of the formed piece and along the length of the longitudinal axis.

16 Claims, 1 Drawing Sheet

FORMED PIECE PARTICULARLY FOR USE AS PACKING MATERIAL METHOD AND APPARATUS FOR ITS MANUFACTURE AND USE

BACKGROUND OF THE INVENTION

The invention relates to a formed piece particularly for use as packing material.

As to the prior art, reference is made generally to the publications U.S. Pat. No. 4,237,776, U.S. Pat. No. 3,799,039, U.S. Pat. No. 3,509,798 and WO 92/05948, from which a formed piece is known. According to techniques disclosed in these publications, it is possible to manufacture packing materials of plate form.

It is also known in the prior art to manufacture of cellular polystyrene which are commonly used as packing material in transport and storage of products in industry and trades, such as mail-order businesses. Form pieces made of cellular polystyrene are light-weight, flexible and easy to use. They are cheap to manufacture on an industrial scale, because a relatively cheap series mold can be used. Also, most form pieces can be recycled.

However there are a number of disadvantages to the above form pieces. For example, form pieces of cellular polystyrene charge static electricity, for this reason their use is not recommended in certain applications. In addition, static electricity makes it more difficult to handle the form pieces. Cellular polystyrene is an oil-based material which, after the cycle of consumption of the form pieces, burdens dumping grounds. In other words, the disposal of form pieces is an environmental problem. It should further be noted that their manufacture is relatively energy-consuming.

SUMMARY OF THE INVENTION

The purpose of this invention is to present a new form piece for use as packing material, whereby a great deal of the above-mentioned problems can be eliminated. To achieve these aims, the form piece of the invention comprises

- a first outer surface forming a surface of a substantially cylindrical type, and
- sheet material twisted in random order inside the form piece so that an air gap is provided between at least some sheet material layers or the like, for at least part of the length of the form pieces.

A form piece arranged in the above-mentioned manner is manufactured of a sheet material, which in this context means particularly decomposable sheet materials, such as paper and/or plastic polymer materials manufactured and/or treated so that they are decomposable. In particular, cellulose-based materials, recycled and/or waste paper can be used. Cellulose-based sheet materials, i.e. those manufactured of paper, are advantageous because they can be recycled by waste paper collection or disposed of by burning or composting. Form pieces of particularly cellulose-based materials do not charge static electricity, so they are easier to use in this respect than form pieces made of cellular polystyrene. Using suitably chosen cellulose-based materials, a form piece according to the invention competes very well in price and functional properties (price/quality ratio) with form pieces of cellular polystyrene currently in use.

When form pieces according to the invention are used as packing material, the surface, wrinkled or treated by working the sheet material in a corresponding manner, induces good internal friction in the packing material and even creates partial mechanical adhesion of form pieces to each other, whereby a product packed by the packing material is kept in position during transportation and storage and does not displace the packing material and sink to the bottom of the package space which might cause a risk of damaging the product because the outer surface of the product is in direct contact with the inner surface of the package without a protective zone provided by the packing material.

The present invention relates also to a method for manufacturing form pieces, particularly for use as packing material, on an industrial scale. The method of the invention is primarily characterized in that a bar-like blank is twisted around its longitudinal axis before cutting it into form pieces (M) of certain length.

With the method presented above, it is possible to manufacture form pieces on an industrial scale by continuous production, naturally within limits determined by the length of the continuous web. In particular, reducing the width of the web or the like, i.e. the dimension transverse to its running direction, causes placement of the sheet material or the like in the cross-sectional area of the bar-like blank in random order so that in at least part of the cross-section, air gaps are left between the sheet material layers, providing the properties of flexibility of the form piece. By rotating the bar-like blank around its longitudinal axis, it is possible to adjust the flexibility and to secure the coherence of the form piece after cutting the twisted bar-like blank. In addition to the flexibility or porosity of the form piece, the weight of the form piece can be adjusted by twisting.

Furthermore, the invention relates to an apparatus for manufacturing form pieces to be used particularly as packing material.

The invention relates also to the use of the form piece as packing material.

BRIEF DESCRIPTION OF THE DRAWINGS

In the following description, the invention will be described in more detail with reference to the appended drawing. In particular.

DESCRIPTION OF THE PREFERRED EMBODIMENTS

Figure 1:
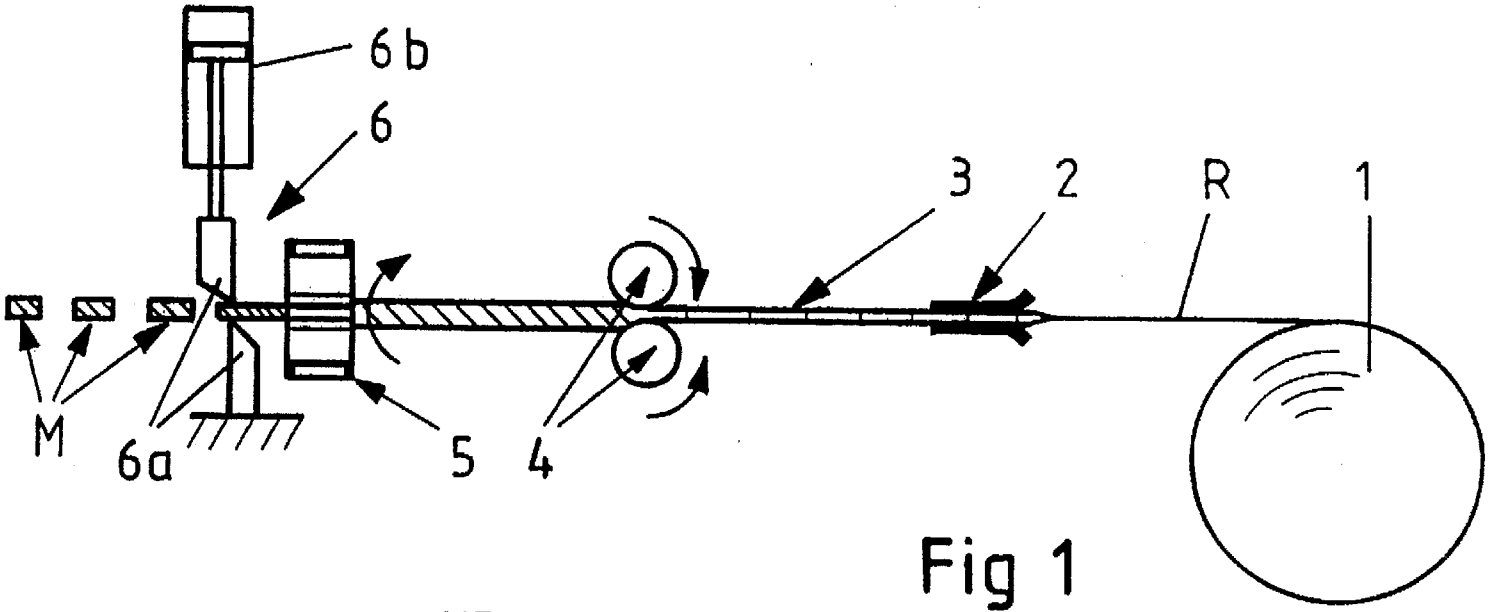
FIG. 1 shows a schematic side view of an embodiment of the technical stages of the method for manufacturing form pieces of the invention on industrial scale.

Referring to FIG. 1, at least one cellulose-based sheet material R, such as paper, particularly recycled and/or waste paper, is arranged on a roll 1 at the starting end of the production line. Unrolling takes place from the roll 1 to a preformation unit 2, where the width of the web or the like is reduced in a direction perpendicular to the running direction of the web in order to produce a bar-like blank 3, whereby the material of the web R is placed in the cross-sectional area of the bar-like blank. The preformation unit 2 can be a conical sleeve tapering in the running direction of the web, through which the web is guided to taper into a bar-like blank.

Next in the production line are friction rollers 4 or corresponding arresting means which prevent the transfer of the twisting of the bar-like blank occurring downstream of the friction rollers 4, upstream of the friction rollers 4 in the incoming direction of the web. The friction rollers 4 can be replaced (or supplemented) by arresting means in the preformation unit 2, preventing the transfer of the twisting of the bar-like blank 3.

Further in the production line, a twisting and drawing unit 5 for the bar-like blank 3 is provided at a distance from the friction rollers 4, whereby the bar-like blank is twisted around its longitudinal axis the cross-sectional area of the bar-like blank being thus reduced in most practical embodiments.

Having passed the twisting and drawing unit 5, the bar-like blank is cut into form pieces M by a cutting unit 6.

At least one roll 1 is placed in an unrolling device which usually does not require particular drive means but only a friction brake. The preformation unit 2 is mounted to be stationary in connection with the production line but to be easily changeable according to the width and/or quality of sheet material of the web. The friction rollers 4 are preferably provided with a control device for controlling the pressure on the bar-like blank 3 to prevent twisting after the friction rollers 4 in the incoming direction. Using the twisting and drawing unit 5, the desired twisting with the desired tension can be achieved in the bar-like blank 3. The twisting and drawing unit 5 comprises (1) means for directing the pressure required on the bar-like blank 3 for accomplishing the force for twisting, i.e. the friction force applied to the surface of the bar-like blank 3, (2) means for rotating the twisting and drawing unit 5 around the longitudinal axis of the bar-like blank 3 to produce the actual twisting, and (3) means for drawing the bar-like blank 3 from the roll 1 and feeding it to the cutting unit 6 at the next stage. The operational sequence of the cutting unit 6 can be adjusted by valve control as directed.

Figure 2:
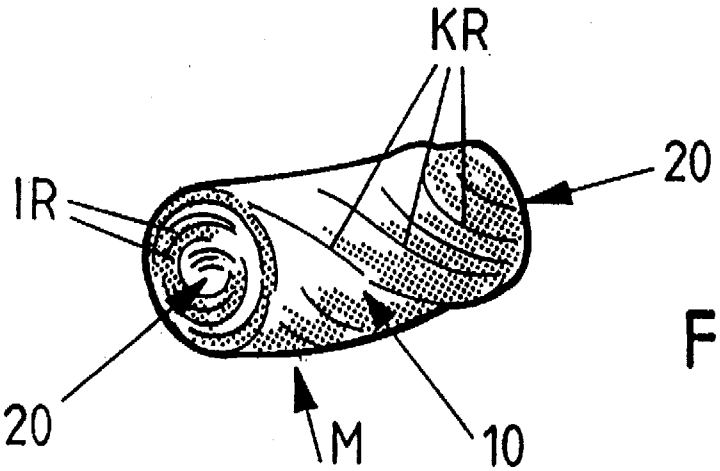
FIG. 2 shows a perspective view of a form piece of the invention, manufactured by the method as shown in FIG. 1.

FIG. 2 shows particularly a form piece produced by the method of FIG. 1, comprising a first outer surface 10 in the longitudinal direction of the form piece, the sheet material or the like of the form piece being in random order in a wrinkled or corresponding spiral form KR. The first outer surface 10 forms a cylindrical surface, within the framework of the random nature of the form of the surface. The ends of the first outer surface 10 are joined by second outer surfaces 20 in the cross-sectional direction of the form piece, where the sheet material or the like forming the form piece is randomly arranged in layers so that an air gap IR is provided between at least some sheet material layers or the like. By adjusting the tension of the twisting of the bar-like blank, the number and size of air gaps can be changed and thus the flexibility and porosity properties of the form piece can be adjusted. The sheet material is twisted in random order inside the form piece so that there is an air gap between at least some sheet material layers or the like on at least part of the length of the form piece, i.e. in the direction between the second outer surfaces. The surfaces of the form piece, in the longitudinal direction on one hand and in the cross-sectional direction on the other hand, are advantageously essentially perpendicular to each other. In other words, the form piece M has substantially a cylindrical form.

Particularly for securing the coherence of the form piece, it is advantageous that the relation between the twisting of the bar-like blank and the determined cutting length is elected so that the twisting of the web material or the like on the first outer surface 10 of the form piece M is substantially at least one full twist from the first end to the second end of the form piece, i.e. between the second outer surfaces 20.

As an embodiment, it can be mentioned that the web R consisting of one or several sheet materials can be treated, by spraying, spreading or in a corresponding manner, with a preferably small addition of an additive, such as a glueing agent, impregnating agent, corrosion preventing agent, or an agent improving the electric properties of the web, etc., before the preformation unit 2, to secure the cohesion and/or to provide further properties of the form piece. The glue can be preferably water-soluble.

What is claimed is:

1. A formed piece for use as packing material, comprising:

said formed piece being substantially cylindrical and having a substantially cylindrical outer surface layer of sheet material extending along a longitudinal axis of the formed piece between a first end and a second end of the formed piece, and inner layers of sheet material surrounded by said outer surface layer, said inner layers being randomly arranged over the cross-sectional area of the cylindrical formed piece and having air gaps between at least portions of said inner layers, and wherein said outer surface layer and said inner layers of sheet material are twisted around the longitudinal axis of the cylindrical formed piece along the whole length of said cylindrical formed piece.

2. A formed piece according to claim 1 wherein surfaces of said first and second ends of said formed piece are essentially perpendicular to said outer surface layer.

3. A formed piece according to claim 1 wherein at least said surface layer of sheet material is twisted one full twist around the longitudinal axis of the formed piece between said first end and said second end of the formed piece.

4. A formed piece according to claim 1 wherein said sheet material is a cellulose-based material.

5. A formed piece according to claim 1 wherein said sheet material is paper.

6. A method for manufacturing formed pieces for use as packing material comprising the steps of:

forming a bar shaped blank, having an outer surface layer and randomly arranged therein inner layers of sheet material, from a feed sheet material by reducing the width of the sheet material, twisting said bar shaped blank around its longitudinal axis thereby reducing the cross-sectional area of the bar shaped blank, and cutting said bar shaped blank into formed pieces, said formed pieces being twisted substantially along their whole length.

7. A method according to claim 6 wherein said twisting step creates air gaps between said inner layers of said bar shaped blank.

8. A method according to claim 6 wherein said twisting and cutting steps collectively create formed pieces with twists on said outer surface layer of each formed piece of at least one full twist extending between a first end and a second end of the formed piece along a longitudinal axis of the formed piece.

9. An apparatus for manufacturing formed pieces used as packing material comprising:

bar shaped blank means for reducing a width of a sheet material and making said sheet material into a bar shaped blank having an outer surface layer and randomly arranged therein inner layers, twisting means for twisting at least a surface layer of said bar shaped blank around its longitudinal axis and for creating air gaps between said inner layers, and cutting means for cutting said bar shaped blank to obtain formed pieces, said pieces being twisted along substantially the whole of their length.

10. An apparatus according to claim 9 further comprising arresting means for preventing twisting of the bar shaped material upstream of the twisting means.

11. An apparatus according to claim 10 wherein said arresting means are friction rollers.

12. An apparatus according to claim 9 wherein said bar shaped blanking means is a conical sleeve for tapering the sheet material as it is transported through the conical sleeve.

13. An apparatus according to claim 9 wherein said twisting means is a twisting and drawing unit.

14. An apparatus according to claim 13 wherein said twisting and drawing unit comprises means for applying pressure to said bar shaped blank and means for rotating the twisting and drawing unit around the longitudinal axis of the bar shaped blank.

15. An apparatus according to claim 9 further comprising uncoiling means for uncoiling a continuous sheet material and said uncoiling means is an unrolling device with friction brake.

16. A formed piece for use as packing material, comprising:

a substantially cylindrical outer surface layer of sheet material extending along a longitudinal axis of the formed piece between a first end and a second end of the formed piece, and inner layers of sheet material randomly arranged within a space defined by said outer surface layer and having air gaps between at least portions of said inner layers, and wherein at least said outer surface layer is twisted around the longitudinal axis of the formed piece along the whole length of said formed piece between said first and second end.

* * * * *